US008886099B2

(12) United States Patent
Kanamori et al.

(10) Patent No.: US 8,886,099 B2
(45) Date of Patent: Nov. 11, 2014

(54) HEATING APPARATUS

(75) Inventors: Akihito Kanamori, Yokohama (JP); Isamu Takeda, Yokohama (JP); Takaaki Akamatsu, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 410 days.

(21) Appl. No.: 13/291,513

(22) Filed: Nov. 8, 2011

(65) Prior Publication Data

US 2012/0122049 A1 May 17, 2012

(30) Foreign Application Priority Data

Nov. 15, 2010 (JP) ..... 2010-254814

(51) Int. Cl.
*G03G 15/20* (2006.01)
*F24J 3/00* (2006.01)

(52) U.S. Cl.
CPC ..... *F24J 3/00* (2013.01); *G03G 15/2057* (2013.01)
USPC ..... 399/329

(58) Field of Classification Search
CPC ..... G03G 15/2057
USPC ..... 399/328, 329
See application file for complete search history.

(56) References Cited

U.S. PATENT DOCUMENTS

| | | | | |
|---|---|---|---|---|
| 5,149,941 | A | 9/1992 | Hirabayashi et al. | |
| 5,300,997 | A | 4/1994 | Hirabayashi et al. | |
| 5,343,280 | A | 8/1994 | Hirabayashi et al. | |
| 5,525,775 | A | 6/1996 | Setoriyama et al. | |
| 5,552,582 | A | 9/1996 | Abe et al. | |
| 5,767,484 | A | 6/1998 | Hirabayashi et al. | |
| 5,852,763 | A * | 12/1998 | Okuda et al. | 399/329 |
| 6,673,750 | B2 * | 1/2004 | Hirata et al. | 508/136 |
| 6,748,192 | B2 | 6/2004 | Izawa et al. | |
| 6,787,737 | B2 * | 9/2004 | Uekawa et al. | 399/329 X |
| 2009/0092426 | A1 | 4/2009 | Nishizawa et al. | |
| 2009/0232432 | A1 * | 9/2009 | Egami et al. | 384/464 |
| 2010/0275571 | A1 * | 11/2010 | Kondo et al. | 59/84 |

FOREIGN PATENT DOCUMENTS

| | | | |
|---|---|---|---|
| JP | 63-313182 | A | 12/1988 |
| JP | 4-044075 | A | 2/1992 |
| JP | 8-16005 | A | 1/1996 |
| JP | 10-10893 | A | 1/1998 |
| JP | 2003-045615 | A | 2/2003 |
| JP | 2006-126576 | A | 5/2006 |
| JP | 2009-25612 | A | 2/2009 |

* cited by examiner

*Primary Examiner* — Sandra Brase
(74) *Attorney, Agent, or Firm* — Fitzpatrick, Cella, Harper & Scinto

(57) ABSTRACT

The present invention is directed to suppressing cracks in the surface layer of the rotating member including fluororesin. According to the present invention, there is provided a heating apparatus comprising: a rotating member which has a surface layer comprising fluororesin, flexibility, and is open at both ends thereof; a heating member for heating the rotating member; a holding member for the rotating member, which is disposed inside the rotating member and has a sliding surface against an inner peripheral surface of the rotating member; and a pressurizing member for forming a nip portion together with the rotating member, the heating apparatus heating a recording material while conveying the recording material by nipping at the nip portion and rotating the rotating member and the pressurizing member, wherein a lubricant comprising a straight-chain and a side-chain type perfluoropolyethers is interposed between the rotating member and the sliding surface of the holding member.

2 Claims, 5 Drawing Sheets

FORMULA 1 : STRAIGHT-CHAIN TYPE 1

$$CF_3O\left[\left(CF_2CF_2O\right)_n\left(CF_2O\right)_m\right]CF_3$$

FORMULA 2 : STRAIGHT-CHAIN TYPE 2

$$CF_3CF_2CF_2O\left(CF_2CF_2CF_2O\right)_n CF_2CF_3$$

FORMULA 3 : SIDE-CHAIN TYPE 1

$$CF_3O\left[\left(CF_2\underset{\underset{CF_3}{|}}{C}FO\right)_n\left(CF_2O\right)_m\right]CF_3$$

FORMULA 4 : SIDE-CHAIN TYPE 2

$$CF_3CF_2CF_2O\left(\underset{\underset{CF_3}{|}}{C}FCF_2O\right)_n CF_2CF_3$$

HEATING APPARATUS

BACKGROUND OF THE INVENTION

1. Field of the Invention

The present invention relates to a heating apparatus used in an electrophotographic image forming apparatus.

2. Description of the Related Art

In image forming apparatuses such as electrophotographic copying machines and printers, conventionally, heat roller-type heat fixing apparatuses are widely used for applying heat and pressure to fix, onto a recording material (sheet), an unfixed toner image supported on the recording material by an image forming process such as an electrophotographic process.

From the standpoint of quick start and saving energy, film heating-type heat fixing apparatuses and electromagnetic induction heating-type heat fixing apparatuses, which cause films themselves to generate heat, have also been put to practical use in recent years.

Film heating-type heat fixing apparatuses are proposed, for example, in Japanese Patent Application Laid-Open Nos. S63-313182 and H04-044075.

The film heating-type heat fixing apparatus includes a heater as a heating member, a fixing film as a flexible rotating member which is in contact with the heater and rotates while applying heat, and a pressure roller as a pressurizing member which forms a fixing nip portion with the heater via the fixing film.

In the film heating-type heat fixing apparatus, a recording material supporting thereon an unfixed toner image is introduced between the fixing film and the pressure roller at the fixing nip portion and conveyed together with the fixing film while being sandwiched. Accordingly, the unfixed toner image is fixed on the surface of the recording material by the pressure of the fixing nip portion with the application of heat from the heater via the fixing film. In this heat fixing apparatus, low heat capacity members are used for the heater and the fixing film, and it is sufficient if the heater, which is a heat source, is energized only at the time of executing image formation to generate heat of a predetermined fixing temperature. Accordingly, the heat fixing apparatus has advantages of a short waiting time from power-on of the image forming apparatus to entry into a state in which image formation can be executed and substantially small power consumption at the time of standby.

Japanese Patent Application Laid-Open No. 2003-045615 discloses a metal sleeve for heating, in which a cylindrical metal element tube is used as a base layer and a release layer is provided on the outer surface. In addition, Japanese Patent Application Laid-Open No. H10-10893 discloses a fixing belt, in which a heat resistant elastomer layer is formed on the outer surface of a metal or heat resistant plastic tube and further, a layer of silicone rubber or fluororesin is formed on the outer surface of the heat resistant elastomer layer.

The use of metal, which has higher thermal conductivity than resin, in place of a conventionally used heat resistant resin, such as polyimide, for a base layer of the fixing film increases the thermal conductivity of the fixing film itself, and accordingly, heat from the heater is more efficiently transferred to the recording material. Therefore, it is possible to accommodate the increase in speed of image forming apparatuses. In addition, a fixing film in which metal is used for the base layer has sufficient strength, thus resulting in an increase in endurance and robustness.

Conventionally, there is a problem that fixing unevenness partially occurs, when the toner image passes through the fixing nip portion, because the surface of the fixing film cannot follow the shape of a toner image which is formed by multiply transferring color images. Fixing unevenness appears as gloss unevenness of an image, or leads to transparency unevenness in the case of OHTs (transparent sheets for overhead projectors) and the transparency unevenness appears as an image defect when projected. To deal with this problem, an elastic layer is provided on the base layer of the fixing film so as to render the surface of the fixing film deformable along the toner layer. Therefore, heat is transferred from the fixing film to the toner disposed unevenly on an image in such a manner that the heat is enclosed by the fixing film, thereby achieving uniform fixing performance.

On the other hand, Japanese Patent Application Laid-Open No. H08-016005 discloses an electromagnetic induction heating-type heat fixing apparatus in which, with magnetic fluxes, eddy currents are induced in a film member and Joule heat of the eddy currents heats the fixing film itself. The heat fixing apparatus is able to directly heat the fixing film by using the occurrence of induced currents, and achieves a more highly efficient fixing process compared to a heat roller-type heat fixing apparatus having a halogen lamp as a heat source.

In electromagnetic induction heating-type heat fixing apparatuses, a thin metal is often used for the base layer of the fixing film. Further, in the case where an electromagnetic induction heating-type heating fixing apparatus is used in a color image forming apparatus, a fixing film having an elastic layer provided on the base layer may be used.

Thus, film heat fixing-type and electromagnetic induction heat fixing-type heat fixing apparatuses have been proposed. However, with any type of heat fixing apparatuses, it is necessary to suppress an offset phenomenon caused by toner adhering to the fixing film and again transferred to a recording material.

Accordingly, a release layer including fluororesin, such as polytetrafluoroethylene-perfluoro alkyl vinyl ether copolymer (PFA) and polytetrafluoroethylene (PTFE), may be provided as a surface layer on the base layer or the elastic layer of the fixing film.

In heat fixing apparatuses using the fixing film described above, a lubricant is interposed between the fixing film and the heater or a sliding member, thereby reducing sliding friction between the fixing film and the heater or the sliding member and smoothing the rotational movement of the fixing film.

Because the heat fixing apparatus may be used under high temperature of 180° C. or more, as the lubricant, a fluorine-based lubricant is adopted which shows excellent stability under severe conditions such as high-temperature environments. The basic constituents of a lubricant are a base oil, a thickener, and an additive, and the fluorine-based lubricant is formed of perfluoropolyether (PFPE) as the base oil, a PTFE homopolymer or copolymer as the thickener, and an added material, such as a small amount of a rust inhibitor, as the additive.

PFPE has any of chemical structures represented by Formulae 1 to 4 of FIG. 5, and is broadly categorized into a straight-chain type having a straight-chain structure and a side-chain type having a side-chain structure with a trifluoromethyl group ($—CF_3$) in its side chain.

The kinetic viscosity of straight-chain type PFPE is less dependent on temperature than that of side-chain type PFPE, as illustrated in FIG. 6. That is, straight-chain type PFPE has a lower viscosity than side-chain type PFPE in a low-temperature environment, and has a higher viscosity in a high-temperature environment. For a heat fixing apparatus, it is desired to reduce drive torque required for start-up from a cold condition in a low-temperature environment, and it is therefore preferred that the lubricant have a lower viscosity in a low-temperature environment, which also facilitates the rotation of the fixing film. In addition, in the case where the heat fixing apparatus is used under high temperature such as at the time of continuous printing, it is desired to prevent the lubricant from draining from edges of the fixing film and being depleted from a sliding friction part. Accordingly, it is preferred that the lubricant have a higher viscosity in a high-temperature environment so that run-off of the lubricant can be prevented. Therefore, straight-chain type PFPE is used as a lubricant for conventional heat fixing apparatuses.

However, even when a lubricant formed of straight-chain type PFPE is used, a fair amount of lubricant held between the fixing film and the heater or the sliding member is drained from the edges of the fixing film and comes around to the surface of the fixing film when the rotational movement of the fixing film is continued for a long period of time.

As a result, the fluororesin, such as PFA, used for the surface layer of the fixing film and the lubricant having come around thereto react with each other, which sometimes causes fissures and cracks in the surface layer of the fixing film. These fissures and cracks appear as horizontal lines across the image, thus sometimes resulting in a decrease in image quality.

As for this mechanism, first, PFPE included in the lubricant as a base oil penetrates into the fluororesin, such as PFA, forming a surface layer of the fixing film, which causes swelling of the fluororesin. With this swelling, the distance between polymers in the fluororesin increases, which results in a decrease in strength of the fluororesin itself. Then, fissures and cracks are considered to be caused in the surface layer by application of mechanical stress, such as rotation, to the fixing film.

For such fissures and cracks in the surface layer of the fixing film, Japanese Patent Application Laid-Open No. 2006-126576 proposes to include polytetrafluoroethylene-perfluoroethoxy ethylene copolymer in the surface release layer of a pressurizing member. In addition, Japanese Patent Application Laid-Open No. 2009-25612 proposes that, in a fixing roller having a resin tube covering the elastic layer as the surface layer, the degree of crystallization of the resin tube is 50% or less.

However, according to examinations conducted by the inventors of the present invention, the inventions disclosed in Japanese Patent Application Laid-Open Nos. S63-313182 and H4-44075 reduce flexibility in material selection or sometimes cause unevenness of film thickness in the surface layer.

SUMMARY OF THE INVENTION

The inventors of the present invention have gone through a great deal of examinations with an object to obtain a lubricant less likely to cause fissures and cracks in fluororesin. As a result, it has been found that a lubricant including side-chain type PFPE in addition to straight-chain type PFPE conventionally used as a lubricant is highly effective in achieving the above-mentioned object.

The present invention is directed to provide a heating apparatus with excellent endurance and heating performance less likely to change after prolonged use of the lubricant.

According to one aspect of the present invention, there is provided a heating apparatus, comprising: a rotating member which has a surface layer comprising fluororesin, has flexibility and is open at both ends thereof; a heating member for heating the rotating member; a holding member for the rotating member, which is disposed inside the rotating member and has a sliding surface against an inner peripheral surface of the rotating member; and a pressurizing member for forming a nip portion together with the rotating member, the heating apparatus heating a recording material while conveying the recording material by nipping at the nip portion and rotating the rotating member and the pressurizing member, wherein a lubricant comprising a straight-chain type perfluoropolyether and a side-chain type perfluoropolyether is interposed between the rotating member and the sliding surface of the holding member.

Further features of the present invention will become apparent from the following description of exemplary embodiments with reference to the attached drawings.

DESCRIPTION OF THE EMBODIMENT

Hereinbelow, an exemplary embodiment of the present invention is illustratively described in detail with reference to the drawings. Note that, however, specifications of constituent elements, sizes of parts, materials, shapes, relative dispositions thereof, and the like described in the embodiment are not meant to limit the scope of the present invention only to these details, unless explicitly stated otherwise herein.

Embodiment

(1) Image Forming Apparatus

Figure 1:
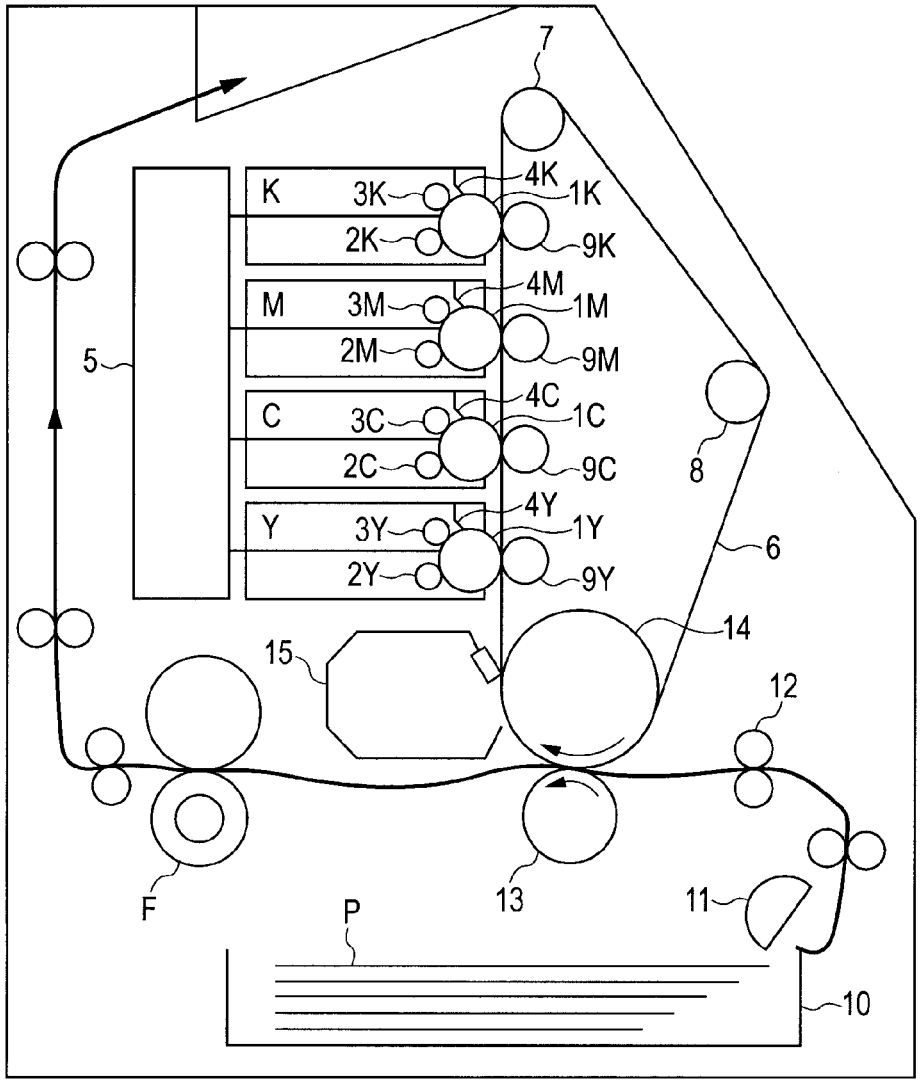
FIG. 1 is a schematic configuration diagram illustrating an example of an image forming apparatus according to the present invention.

FIG. 1 is a schematic configuration diagram illustrating an example of an image forming apparatus according to the present invention.

A full-color image forming apparatus of this embodiment uses an electrophotographic system and obtains a full-color image by superposing toner images of four colors of yellow, cyan, magenta, and black.

The full-color image forming apparatus of this embodiment has a process speed of 115 mm/sec and a print volume of 20 LTR pages per minute.

The full-color image forming apparatus of this embodiment uses so-called all-in-one cartridges which incorporate members, such as photosensitive drums (1Y, 1C, 1M, and 1K) which function as image supporting members, charging rollers (3Y, 3C, 3M, and 3K) which function as charging units, developing rollers (2Y, 2C, 2M, and 2K) which function as developing units for developing an electrostatic latent image into a visible image, and cleaning units (4Y, 4C, 4M, and 4K) of the photosensitive drums, into one container.

The respective cartridges are a yellow cartridge in which a yellow (Y) toner is filled in a developing device, a magenta cartridge in which a magenta (M) toner is filled in a developing device, a cyan cartridge in which a cyan (C) toner is filled in a developing device, and a black cartridge in which a black (K) toner is filled in a developing device. The full-color image forming apparatus described above is loaded with the above-mentioned cartridges of four colors.

In the full-color image forming apparatus according to this embodiment, an optical system 5, which forms electrostatic latent images by exposing the photosensitive drums (1Y, 1C, 1M, and 1K), is provided corresponding to the above-mentioned toner cartridges of four colors. As the optical system 5, a laser scanning exposure optical system is used.

Scanning light emitted from the optical system 5 based on image data is incident for exposure on the photosensitive drums (1Y, 1C, 1M, and 1K) uniformly charged by the charging rollers (3Y, 3C, 3M, and 3K), respectively, and therefore, electrostatic latent images corresponding to an image are formed on the surfaces of the respective photosensitive drums (1Y, 1C, 1M, and 1K). A developing bias applied to the respective developing rollers (2Y, 2C, 2M, and 2K) by a bias supply (not shown) is set to an appropriate value between a charged potential and a latent (exposed part) potential. Therefore, toner charged to the negative polarity selectively attaches to the electrostatic latent image on each of the photosensitive drums (1Y, 1C, 1M, and 1K), and thereby development is performed.

Respective single color toner images developed on the photosensitive drums (1Y, 1C, 1M, and 1K) are transferred onto an intermediate transfer member rotating in synchronization with the photosensitive drums (1Y, 1C, 1M, and 1K) at a constant speed.

This embodiment uses, as the intermediate transfer member, an intermediate transfer belt 6 which is driven by a driving roller 7 and supported by a tension roller 8 in a tensioned state. As a primary transfer unit for transferring the toner images on the photosensitive drums (1Y, 1C, 1M, and 1K) to the intermediate transfer belt 6, primary transfer rollers (9Y, 9C, 9M, and 9K) are used. A primary transfer bias having an opposite polarity to that of toner is applied by the bias supply (not shown) to the primary transfer rollers (9Y, 9C, 9M, and 9K), with the result that the toner images are primary-transferred to the intermediate transfer belt 6. After the primary transfer, toner remaining on the photosensitive drums (1Y, 1C, 1M, and 1K) as a transfer residue is removed by the cleaning units (4Y, 4C, 4M, and 4K).

The above-mentioned processes are performed for the respective colors of yellow, magenta, cyan, and black in synchrony with the rotation of the intermediate transfer belt 6, and the primary-transferred toner images of the respective colors are sequentially superposed one on top of the other on the intermediate transfer belt 6. In the case of image formation in a single color (monochrome mode) only, the above-mentioned processes are performed only for the target color.

In addition, a recording material P set in a recording material cassette 10, which functions as a recording material supply part, is fed by a feeding roller and conveyed by registration rollers 12 at a predetermined timing to a nip portion formed by the intermediate transfer belt 6 and a secondary transfer roller 13, which functions as a secondary transfer unit, in a secondary transfer part. A bias having an opposite polarity to that of toner is applied by a bias applying unit (not shown) to the secondary transfer roller 13 functioning as the secondary transfer unit, with the result that the primary-transferred toner images formed on the intermediate transfer belt 6 are collectively transferred onto the recording material P. Note that, an opposing roller 14 is disposed to oppose the secondary transfer roller 13. The recording material P to which toner has been secondary-transferred is conveyed to a heat fixing apparatus F. The recording material P is heated and pressurized as passing through the heat fixing apparatus F, with the result that the toner image is heated and fixed onto the recording material P. Then, the recording material P is discharged from the heat fixing apparatus F to a tray outside the image forming apparatus. A secondary transfer residual toner remaining on the intermediate transfer belt 6 after the secondary transfer is removed by an intermediate transfer belt cleaning unit 15.

(2) Heat Fixing Apparatus F

Figure 2:
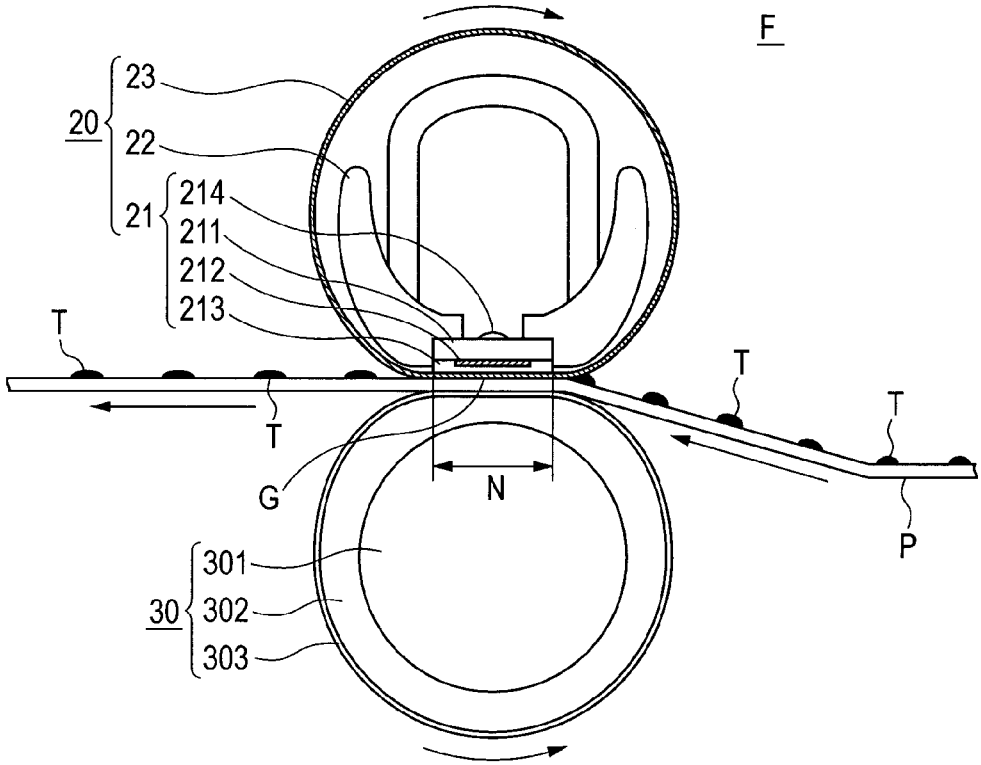
FIG. 2 is a cross-sectional view of a heating apparatus according to the present invention.
Figure 3:
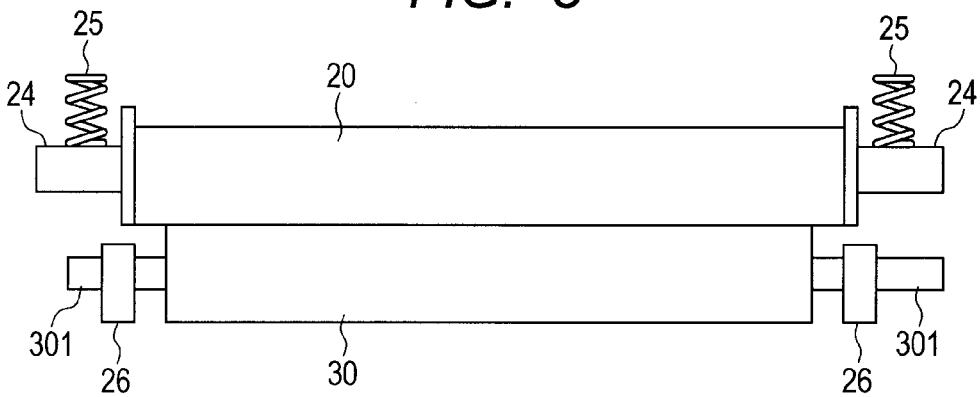
FIG. 3 is a horizontal side view of the heating apparatus according to the present invention.

FIG. 2 is a cross-sectional view of the heat fixing apparatus F functioning as an image heating apparatus. Note that, FIG. 2 is a cross-sectional view along the conveyance direction of the recording material P. Also, FIG. 3 is a horizontal side view of the heat fixing apparatus F. Here, the schematic configuration of the heat fixing apparatus F is described first, and the components are described in detail later.

The heat fixing apparatus F includes a fixing member (heating assembly) 20 as a heating member and a pressure roller 30 as a pressurizing member. The fixing member 20 and the pressure roller 30 are brought into contact with each other in a pressurized state (press contact with each other), thereby forming a fixing nip portion N functioning as a nip portion.

The fixing member 20 includes a heater 21 as a heating member, a guide 22 as a holding member, a fixing film 23 as a rotating member which is heated by the heater 21, and end flanges 24 (hereinafter referred to as "fixing flanges") as regulating members. The heater 21 is disposed on the lower surface of the guide 22 in a fixed manner. The fixing film 23 is disposed in such a manner as to fit onto the guide 22. The fixing flanges 24 are respectively mounted to both end portions of the guide 22 in a longitudinal direction of the guide 22, and serve to regulate both end portions of the fixing film 23 which is open at both ends. Here, the longitudinal direction of the members, such as the heat fixing apparatus F, the fixing member 20, and the guide 22, refers to a direction in which a rotational axis assumed at the time of rotation of the fixing film 23, which is open at both ends, extends. The longitudinal direction is also a sheet width direction of the recording material P, orthogonal to the conveyance direction of the recording material P.

In addition, at both the end portions in the longitudinal direction of the fixing member 20, pressure springs 25 are respectively provided on the fixing flanges 24 in a compressed manner. With the pressure springs 25, the fixing member 20 is pressed against the top surface of the pressure roller 30 under a predetermined pressurizing force, resisting the elasticity of an elastic layer 232, to be described later, of the fixing film 23 and the elasticity of an elastic layer 302 of the pressure roller 30, with the result that the fixing nip portion N having a predetermined width is formed. Note that, a cored bar 301 to be described later is held by supporting members 26, with the result that the pressure roller 30 is rotatably fixed. At the fixing nip portion N, due to the pressurization of the fixing member 20 against the pressure roller 30, the fixing film 23 sags following the flat plane of the lower surface of the heater 21 when sandwiched in between the heater 21 and the pressure roller 30. Therefore, the inner surface of the fixing film 23 is brought into close contact with the flat plane of the lower surface of the heater 21, specifically, with a protective layer 213, to be described later, of the heater 21. The guide 22 is disposed inside the fixing film 23 and has a sliding surface against the inner peripheral surface of the fixing film 23. The pressure roller 30 forms the fixing nip portion N together with the fixing film 23.

Along with the rotational drive of the pressure roller 30, a rotational force is exerted on the fixing film 23 due to a frictional force between the pressure roller 30 and the fixing film 23 on the fixing member 20 side at the fixing nip portion N. Then, the fixing film 23 is brought into close contact with the lower surface of the heater 21 disposed on the inner side of the fixing film 23, and driven around the outer peripheral surface of the guide 22 in a clockwise direction by the rotation of the pressure roller 30 with a sliding motion on the sliding surface, with the result that the fixing film 23 enters a rotational state (pressure roller driven type).

Note that, the pressurizing member may be in the form of a belt like a rotating belt, other than the pressure roller 30 of this embodiment.

Because the fixing film 23 rotates while frictionally sliding on the heater 21 and the guide 22 disposed inside the fixing film 23, the frictional resistance between the fixing film 23 and the heater 21 and between the fixing film 23 and the guide 22 need to be controlled to be small. Therefore, a small amount of heat resistant lubricant G is provided on the surfaces of the heater 21 and the guide 22, for example, between the fixing film 23 and the sliding surfaces of the heater 21 and the guide 22.

The heater 21 heats the fixing nip portion N which melts and fixes a toner image T on the recording material P. While the fixing film 23 is being slidingly moved on the sliding surface, in other words, while the fixing film 23 is rotating due to the rotation of the pressure roller 30, the temperature of the heater 21 rises to a predetermined temperature due to the energization of the heater 21 and is subsequently regulated. In this condition, the recording material P supporting the unfixed toner image T is conveyed between the fixing film 23 and the pressure roller 30 at the fixing nip portion N along a fixing inlet guide (not shown). Then, the recording material P is conveyed while being sandwiched at the fixing nip portion N, with the result that the unfixed toner image T on the recording material P (on the heated material) is heated by the heat from the heater 21 via the fixing film 23 and heat-fixed onto the recording material P (onto the sheet). The recording material P passing through the fixing nip portion N is separated from the outer surface of the fixing film 23 and discharged onto a discharge tray after being guided by a heat resistant fixing sheet discharge guide (not shown).

(2a) Heater 21

The heater 21 is a heating member disposed inside the fixing film 23. As illustrated in FIG. 2, the heater 21 has an elongated substrate 211 made of a high insulating ceramics, such as alumina (aluminum oxide) and aluminum nitride (AlN), or a heat resistant resin, such as polyimide, PPS, and a liquid crystal polymer. On the surface of the substrate 211, a heating element 212 which is printed as a heat generating paste layer made, for example, of silver-palladium (Ag/Pd), $RuO_2$, or $Ta_2N$, and the protective layer 213, such as a pressure resistant glass, for ensuring insulation and protection of the heating element 212 are sequentially formed.

Power is fed to the heat generating paste on the heater 21 from a power feeding part (not shown) via a connector (not shown). On the back surface of the heater 21, a temperature detecting element 214, such as a thermistor, is disposed for detecting the temperature of the heater 21 which rises according to the heat generation of the heat generating paste. According to a signal of the temperature detecting element 214, factors, such as the duty ratio and the wave number, of the voltage applied to the heat generating paste from an electrode portion of the power feeding part (not shown) disposed at an end portion in the longitudinal direction of the heater 21 are controlled appropriately, with the result that the regulated temperature within the fixing nip portion N is maintained substantially constant. Therefore, via the fixing film 23, the heater 21 provides necessary heating for fixing the unfixed toner image T on the recording material P. DC energization of a temperature control part (not shown) by the temperature detecting element 214 is obtained by a connector (not shown) via a DC energizing part and DC electrode portion (not shown).

Note that, the heater 21 which is the heating member is not limited to a ceramic heater, and a heating member such as an electromagnetic induction heating member including a ferromagnetic material, such as an iron plate, may be used instead.

In this embodiment, the heater 21 including alumina as the substrate 211, Ag/Pd as the heating element 212, and pressure resistant glass as the protective layer 213 of the heating element is used.

(2b) Guide 22

The guide 22 as the holding member serves as a support for the heater 21, a pressurizing member, and a heat insulating member for preventing heat dissipation in the opposite direction from the fixing nip portion N. The guide 22 is a rigid, heat resistant, and heat insulating member, and is formed of a material such as a liquid crystal polymer, a phenolic resin, PPS, and PEEK. The guide 22 is disposed inside the fixing film 23.

In this embodiment, a liquid crystal polymer is used as a material of the guide 22.

(2c) Pressure Roller 30

The pressure roller 30 is a pressurizing member disposed to be opposed to the heater 21 with the fixing film 23 interposed therebetween. As illustrated in FIG. 2, the pressure roller 30 includes the cored bar 301 made of metal, such as a stainless steel, SUM, and Al, and the elastic layer 302, which is formed of heat resistant rubber such as silicone rubber and fluororubber or formed by foaming silicone rubber, formed outside the core bar 301. In addition, in order to improve releasability and abrasion resistance, a release layer 303 made of, for example, PFA, PTFE, or polytetrafluoroethylene-hexafluoropropylene copolymer (FEP) may be formed to cover the elastic layer 302.

In this embodiment, the pressure roller 30 having an outer diameter of 20 mm is used, which includes Al as the cored bar 301, silicone rubber as the elastic layer 302, and PFA as the release layer 303.

(2d) Fixing Film 23

The fixing film 23 is a rotating member which is interposed between the heater 21 and the pressure roller 30 and provides heat of the heater 21 to the recording material P while sandwiching and conveying the recording material P at the fixing nip portion N, where the fixing film 23 comes into contact with the pressure roller 30.

Figures 4, 5:
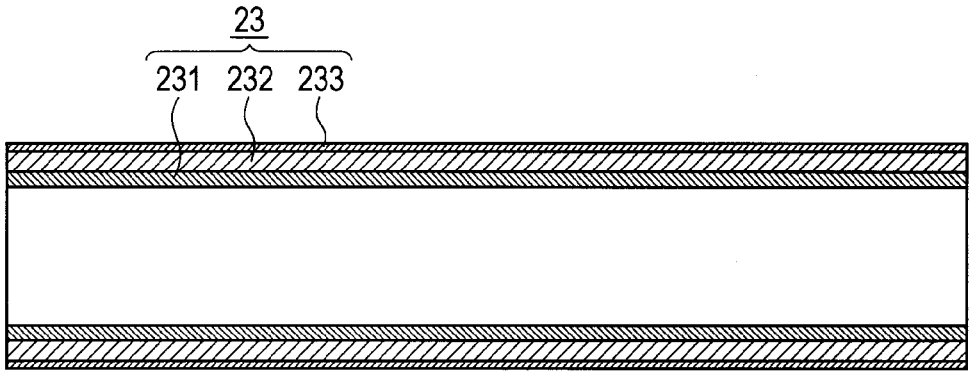
FIG. 4 is a cross-sectional view of a fixing film functioning as a rotating member, used in the heating apparatus of the present invention.
FIG. 5 shows formulae illustrating a variation of chemical structures of PFPE.
Figure 6:
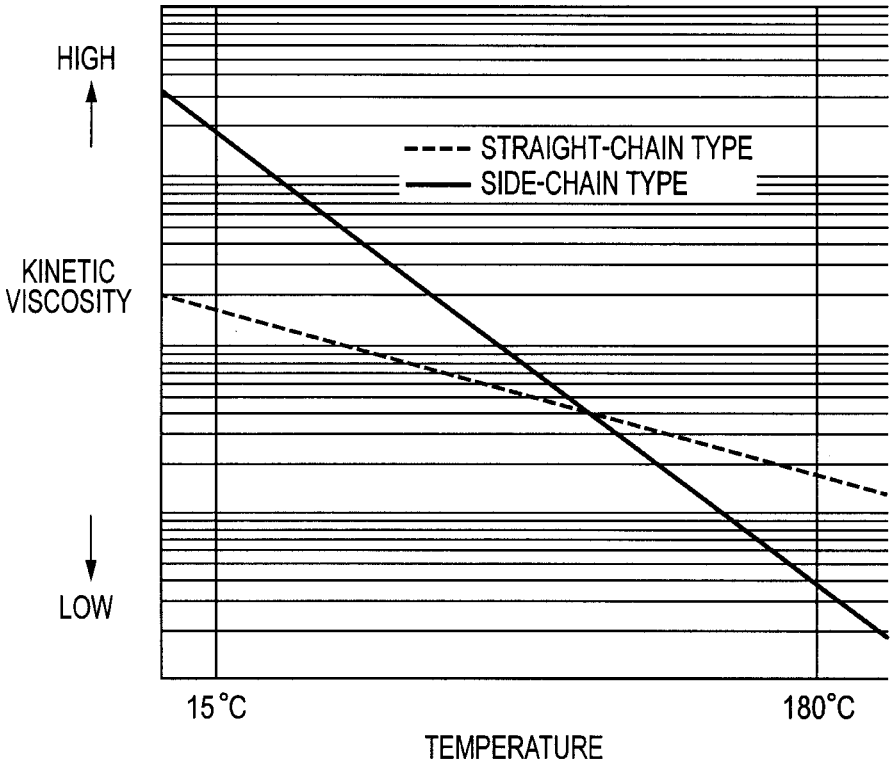
FIG. 6 illustrates a correlation between temperature and kinetic viscosity of lubricants each having a different structural formula of a base oil.

As illustrated in FIG. 4, the fixing film 23 is open at both ends, and includes a base layer 231 formed of a flexible endless belt having a small heat capacity, the elastic layer 232 having elasticity and disposed to cover the base layer 231, and a release layer 233 having releasability and disposed to cover the elastic layer 232.

In order to enable quick start, the base layer 231 is 200 μm or less in thickness, is made of a single metal, such as a stainless steel, Al, Ni, Cu, and Zn, or an alloy having heat resistance and high thermal conductivity, and has flexibility. On the other hand, the base layer 231 needs to be 15 μm or more in thickness to have sufficient strength and excellent endurance in order to form the fixing film 23 with a long life. On the inner surface of the base layer 231, which is in contact with the heater 21, a high sliding layer made of, for example, fluororesin, polyimide, or polyamide-imide may be formed.

In addition, the base layer 231 may be made of a flexible heat resistant resin, such as polyimide, polyamide-imide, PEEK, and PES. In the case where the base layer 231 is made of a resin, a high thermal conductive powder, such as BN, alumina, and Al, may be mixed therein. The thickness needs to be 15 μm or more to 200 μm or less, as in the case where the base layer 231 is made of a metal.

With a view to achieve a sufficient toner fixing property and prevent fixing unevenness for supporting high quality imaging and colorization, the elastic layer 232 is made of a heat resistant elastic member, such as silicone rubber, to transfer heat to the unfixed toner image T on the recording material P in such a manner that the heat is enclosed by the elastic layer 232. In order to support high quality imaging and colorization with the use of the heat enclosure effect, the elastic layer 232 needs to be 30 μm or more in thickness. On the other hand, in order to enable quick start, the thickness needs to be 500 μm or less. In addition, the elastic layer 232 includes an additive, such as a thermal conductive filler, in order to improve the thermal conductivity.

In order to improve releasability and abrasion resistance, the release layer 233, which is a surface layer of the fixing film 23, is disposed on the elastic layer 232 by tube molding or coating of fluororesin, such as PFA, PTFE, and FEP. For abrasion resistance against the recording material P due to sheet feeding, the release layer 233 needs to be 5 μm or more in thickness, and on the other hand, the thickness needs to be 100 μm or less in order to enable quick start.

In this embodiment, the fixing film 23 with an outer diameter of 18 mm is used, which includes 30 μm thick stainless steel as the base layer 231, 200 μm thick high thermal conductive silicone rubber as the elastic layer 232, and 20 μm thick PFA tube as the release layer 233.

(2e) Lubricant G

In order to control the frictional resistance between the fixing film 23 and the heater 21 and between the fixing film 23 and the guide 22 to be small and maintain stable sliding performance throughout the life of the heat fixing apparatus F, the lubricant G is applied between the fixing film 23 and the sliding surfaces of the heater 21 and the guide 22. Because the heater 21 may be used at a temperature of 180° C. or more, as the lubricant G, fluorine-based lubricant is used which shows excellent stability under severe conditions such as high-temperature environments. The lubricant G is formed of a base oil and a thickener, and an additive such as a rust inhibitor may be added thereto.

As the base oil, perfluoropolyether (PFPE) is used. PFPE has any of chemical structures represented by Formulae 1 to 4 of FIG. 5, and is broadly categorized into a straight-chain type (Formulae 1 and 2) having a straight-chain structure and a side-chain type (Formulae 3 and 4) having a side-chain structure with a trifluoromethyl group ($—CF_3$) in its side chain. As for the lubricant G according to the present invention, the base oil includes a mixture of straight-chain type PFPE and side-chain type PFPE.

In this embodiment, a base oil is used which is formed by blending the straight-chain type base oil represented by Formula 1 and the side-chain type base oil represented by Formula 3 at a predetermined ratio. On the other hand, as a thickener, a fine powder of polytetrafluoroethylene (PTFE) with an average particle diameter of 30 μm or less is used. In order to produce the lubricant G of a predetermined consistency, the thickener is combined with the base oil to be 20 wt % or more to 50 wt % or less. In this embodiment, the lubricant G having a consistency of 265 or more to 295 or less (Japanese Industrial Standard JIS K 2220) is used.

(3) Examinations of Cracks Occurring in Release Layer 233 of Fixing Film 23

Figure 7:
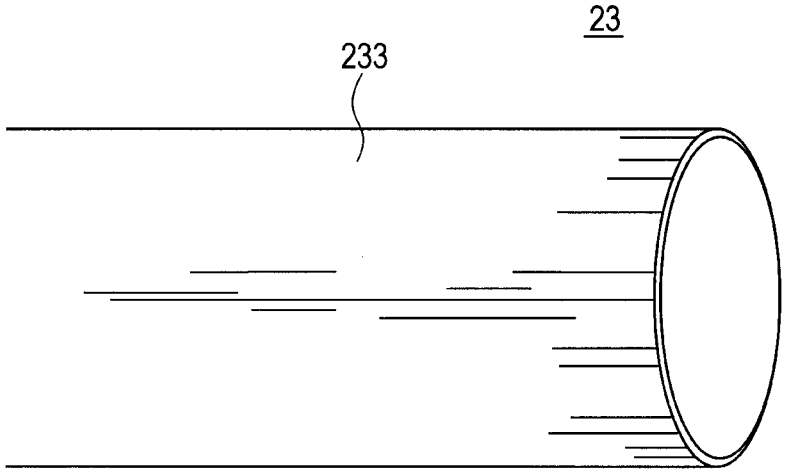
FIG. 7 illustrates an example of the fixing film functioning as the rotating member, in which surface cracks have occurred.
Figure 8:
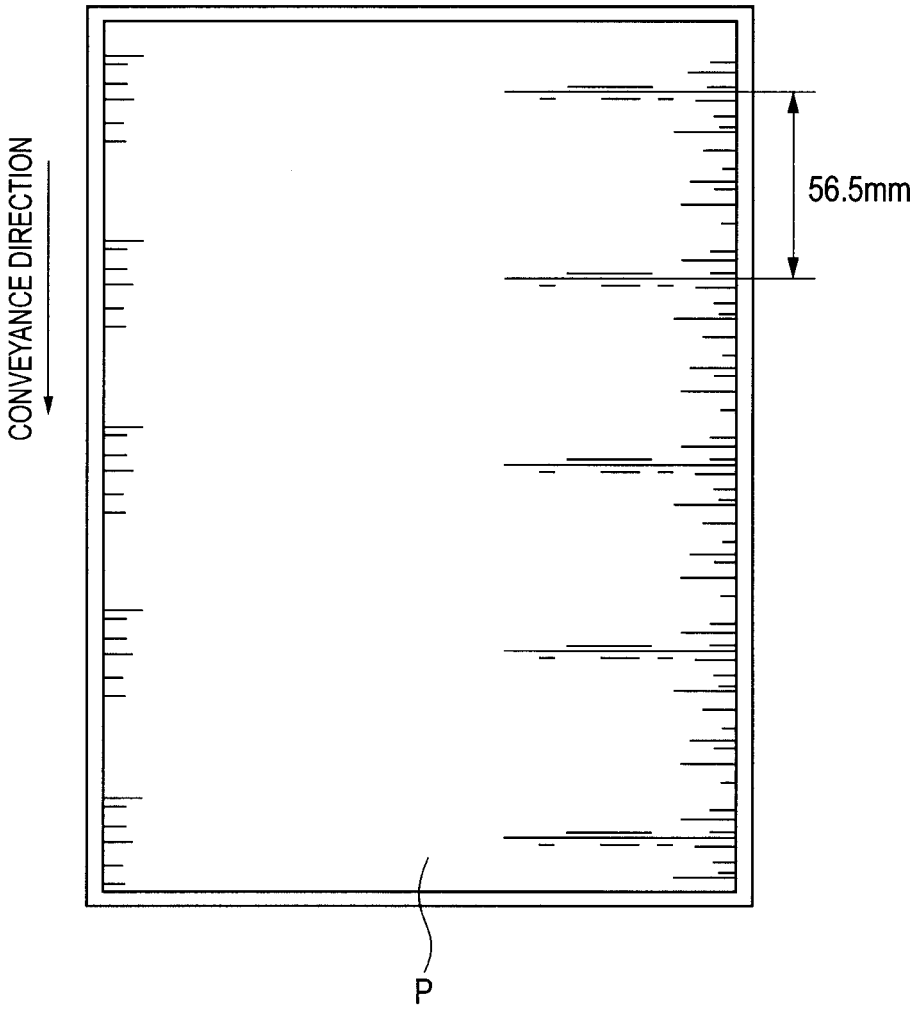
FIG. 8 illustrates an example of an image defect caused by the surface cracks of the fixing film functioning as the rotating member.

When the heat fixing apparatus F is used for a long period of time, the lubricant interposed between the fixing film 23 and the heater 21 and guide 22 is drained from the edges of the fixing film 23 and comes around to the surface of the fixing film 23. Here, in the case where the lubricant is the one including only straight-chain type PFPE as the base oil, a PFA tube used for the release layer 233, which is the surface layer of the fixing film 23, and the lubricant having come around thereto react with each other, which sometimes causes cracks in the release layer 233 as illustrated in FIG. 7. The cracks appear as horizontal lines across an image as illustrated in FIG. 8, thus sometimes resulting in a decrease in image quality. The horizontal lines caused by the cracks correspond to the positions of the cracks in the fixing film 23, and because the outer diameter of the fixing film 23 is 18 mm, the same horizontal lines are repeated on the image with a pitch of about 56.5 mm. In addition, the horizontal lines are readily noticeable in a solid image with a large amount of toner, and further noticeable when light is transmitted through the image on a transparent sheet, such as an OHT.

As for this mechanism, at the time of printing, the surface temperature of the fixing film 23, that is, the temperature of the release layer 233 which is the surface layer of the fixing film 23, reaches a high temperature of 120° C. or more, which exceeds the glass-transition temperature of PFA forming the release layer 233. Therefore, straight-chain type PFPE included in the lubricant as the base oil easily penetrates into PFA, and swelling of PFA is also likely to take place. With this swelling, the distance between polymers in PFA increases, which results in a decrease in strength of PFA itself. In this condition, when printing is stopped and the surface temperature of the fixing film 23 is lowered to about room temperature, the rigidity of PFA increases with the decreased strength of PFA. Therefore, in a subsequent operation, such as printing, starting from room temperature, cracks are considered to be caused in the release layer 233 by application of mechanical stress, such as rotational drive, to the fixing film 23 when the surface temperature of the fixing film 23 is low, that is, when PFA is brittle.

(3a) Preparation of Various Lubricants

First, lubricants of Examples 1 to 3 were prepared, in which the base oil was formed by blending straight-chain type (Formula 1 in FIG. 5) PFPE and side-chain type (Formula 3 in FIG. 5) PFPE. As for the lubricants of Examples 1 to 3, the molecular weights and blending ratio of straight-chain type PFPE and side-chain type PFPE in the base oil are shown in Table 1.

In addition, prepared as lubricants of Comparative Examples 1 to 3 were lubricants (Comparative Examples 1 and 2) including a straight-chain type (Formula in FIG. 5) base oil only, which were conventional examples, and a lubricant (Comparative Example 3) including a side-chain type (Formula 3 in FIG. 5) base oil only. As for the lubricants of Comparative Examples 1 to 3, the molecular weights and composition ratio of PFPE in the base oil are shown in Table 1. Note that, the same thickener was used for all of the lubricants.

(3b) Accelerated Testing of Fixing Film

Accelerated testing was performed using the following method in order to evaluate whether cracks occurred in the fixing film using the lubricants of Examples 1 to 3 and Comparative Examples 1 to 3 prepared in the above-mentioned section (3a).

1) Apply a lubricant directly to the surface of the fixing film 23 of the heat fixing apparatus F illustrated in FIG. 2.

2) Idly rotate the heat fixing apparatus F for ten minutes with temperature regulation at 200° C. while no recording material P is fed.

3) Leave the heat fixing apparatus F for one hour after stop of the idle rotation to cool the heat fixing apparatus F to about room temperature.

4) Print a solid image in a single color of yellow using an OHT sheet and verify the presence or absence of horizontal lines (presence or absence of cracks) as illustrated in FIG. 8 on the image.

5) In the case of no occurrence of cracks, verify whether cracks occur by repeating the above-mentioned steps 1) to 4) five times.

The results are shown in Table 1.

PFPE in terms of the chemical structure, and therefore, straight-chain type PFPE has a property of easy penetration into PFA.

On the other hand, in terms of the chemical structure, side-chain type PFPE has a trifluoromethyl group in its side chain, and side-chain type PFPE tends to be stuck in PFA at the time of penetration into PFA because the side chains cause steric hindrance. As a result, side-chain type PFPE has a property of causing a smaller amount of penetration into PFA compared to straight-chain type PFPE. Because the degree of the swelling changes according to the amount of penetration into PFA, straight-chain type PFPE causing a large amount of penetration is likely to decrease the strength of PFA, that is, straight-chain type PFPE is likely to cause cracks in the release layer 233 of the fixing film 23.

Here, in the case of blending straight-chain type PFPE and side-chain type PFPE together as in the examples, side-chain type PFPE has a higher fluidity in a high-temperature environment because the kinetic viscosity of side-chain type PFPE is more dependent on temperature compared to that of straight-chain type PFPE. Therefore, side-chain type PFPE has a property of easily penetrating into PFA, which is the release layer 233 of the fixing film 23, before straight-chain type PFPE penetrates into PFA. As described above, even when penetrated into PFA, side-chain type PFPE tends to be

TABLE 1

| | Base oil | | | | Accelerated testing of cracks in surface layer (Presence or absence of horizontal lines on image) | | | | |
|---|---|---|---|---|---|---|---|---|---|
| | Straight-chain type | | Side-chain type | | | | | | |
| Lubricant | Molecular weight | Blending ratio | Molecular weight | Blending ratio | First | Second | Third | Fourth | Fifth |
| Example 1 | 8,000 | 80% | 7,000 | 20% | None | None | Present | — | — |
| Example 2 | 8,000 | 50% | 7,000 | 50% | None | None | None | None | None |
| Example 3 | 8,000 | 20% | 7,000 | 80% | None | None | None | None | None |
| Comparative Example 1 | 8,000 | 100% | — | 0% | Present | — | — | — | — |
| Comparative Example 2 | 12,000 | 100% | — | 0% | Present | — | — | — | — |
| Comparative Example 3 | — | 0% | 7,000 | 100% | None | None | None | None | None |

As shown in Table 1, in the case of Comparative Examples 1 and 2 of the lubricants including the straight-chain type base oil only, cracks occurred in the first round of the accelerated testing regardless of the change in the molecular weights. On the other hand, in the case of Comparative Example 3 of the lubricant including the side-chain type base oil only, no cracks occurred in all five rounds of the accelerated testing.

On the other hand, as for the examples of the lubricants including a blend-type base oil, in the case of Example 1 of the lubricant having a blending ratio of the straight-chain type as much as 80%, cracks occurred in the third round of the accelerated testing. However, in the case of Examples 2 and 3 of the lubricants having a blending ratio of the straight-chain type of 50% or less, no cracks occurred in all five rounds of the accelerated testing (Examples 2 and 3).

Thus, simply by blending a small amount of the side-chain type base oil with the straight-chain type base oil as in Example 1, the occurrence of cracks was significantly suppressed compared to the case of using the straight-chain type base oil only as in Comparative Examples 1 and 2. This is considered due to the chemical structures of PFPE used for the base oil. There is no steric hindrance in straight-chain type stuck in PFA due to the steric hindrance of the side chains. Therefore, by penetrating the side-chain type PFPE into PFA first, side-chain type PFPE is considered to fulfill a function of blocking straight-chain type PFPE from penetrating into PFA later. That is, by including even a small amount of side-chain type PFPE in the lubricant, it is possible to suppress cracks in PFA, which is the release layer 233 of the fixing film 23.

In the comparison examinations, with Example 1, cracks occurred in the third round of the accelerated testing, however, this is the result of the accelerated testing, and cracks did not occur in endurance testing in which one hundred thousand sheets were fed using the image forming apparatus of this embodiment. On the other hand, as for Comparative Example 1 with which cracks occurred in the first round of the accelerated testing, cracks also occurred in the sheet feeding endurance testing. That is, the results of the accelerated testing indicate relative superiority and inferiority in terms of crack suppression, and for those with which cracks are less likely to occur in comparison even though cracks occurred in the accelerated testing, it is possible to practically prevent the occurrence of cracks according to specifications of the heat fixing apparatus F and image forming apparatus used. Thus, according to the specifications of the heat fixing apparatus F and the image forming apparatus, the blending ratio of straight-chain type PFPE to side-chain type PFPE effective in crack suppression is different. As a result, the present invention does not particularly set limits on the blending ratio of straight-chain type PFPE to side-chain type PFPE, but specifies the inclusion of at least side-chain type PFPE.

Note that, this embodiment is described using PFA as the release layer 233 of the fixing film 23, but there is no limitation as long as the release layer 233 is made of fluororesin, and the release layer 233 may be made of PTFE or FEP. Because of different glass-transition temperatures and crystalline states depending on the type of resin, different resins have different conditions of crack occurrence and levels of the occurrence, but the effect of suppressing the penetration of PFPE can be achieved in a similar fashion according to this embodiment.

In addition, this embodiment is described using a tube molded product made of PFA as the release layer 233 of the fixing film 23, but the release layer 233 may be a coating material. Because the manufacturing process using the tube molded products involves stretching at the time of molding and covering, the tube molded products tend to cause cracks depending on the orientation of resin by stretching, but coating materials also cause swelling due to penetration of PFPE, and therefore, cracks may occur depending on coating conditions. Because at least the surface nature, strength, and abrasion resistance of the release layer 233 of the fixing film 23 are decreased due to swelling caused by penetration of PFPE, it is possible to achieve the effect of this embodiment in a similar fashion.

(4) Comparison of Starting Torque of Heat Fixing Apparatus F in Low-Temperature Environment Next, using the lubricants described above, a comparison examination was conducted on the starting torque of the heat fixing apparatus F in a low-temperature environment, which was thought to be a concern in the case of using side-chain type PFPE as the base oil of the lubricant.

As for the starting torque of the heat fixing apparatus F, a drive torque was measured in a low-temperature environment of 15° C. with the heat fixing apparatus F in a cold-start state. The results are shown in Table 2.

TABLE 2

| | Base oil | | | | Starting torque (Low-temperature environment) [kgf · cm] |
|---|---|---|---|---|---|
| | Straight-chain type | | Side-chain type | | |
| Lubricant | Molecular weight | Blending ratio | Molecular weight | Blending ratio | |
| Example 1 | 8,000 | 80% | 7,000 | 20% | 2.9 |
| Example 2 | 8,000 | 50% | 7,000 | 50% | 3.0 |
| Example 3 | 8,000 | 20% | 7,000 | 80% | 4.2 |
| Comparative Example 1 | 8,000 | 100% | — | 0% | 2.8 |
| Comparative Example 2 | 12,000 | 100% | — | 0% | 4.1 |
| Comparative Example 3 | — | 0% | 7,000 | 100% | 6.0 |

As shown in Table 2, in the case of Comparative Examples 1 and 2 of the lubricants including the straight-chain type base oil only, the starting torque increased with increased molecular weight. On the other hand, in the case of Comparative Example 3 of the lubricant including the side-chain type base oil only, the starting torque significantly increased compared to the straight-chain type base oil having substantially the same molecular weight (Comparative Example 1). As for the examples of the lubricants including a blend-type base oil, even though the blending ratio of the side-chain type base oil was as much as 80%, the starting torque was significantly low (Example 3) compared to Comparative Example 3 of the lubricant including the side-chain type base oil only. Further, when the blending ratio of the side-chain type base oil was 50% or less (Examples 1 and 2), the starting torque was substantially equal to that of Comparative Example 1 of the lubricant including the straight-chain type base oil only.

Thus, simply by blending a small amount of the straight-chain type base oil with the side-chain type base oil as in Example 3, the starting torque of the heat fixing apparatus F in a low-temperature environment was significantly reduced compared to the case of using the side-chain type base oil only as in Comparative Example 3. This is considered due to an improvement in fluidity of the lubricant, starting from a partial region. The partial region showing good fluidity even in a low-temperature environment is created by blending even a small amount of the straight-chain type base oil, having kinetic viscosity less dependent on temperature, with the side-chain type base oil.

That is, the starting torque of the heat fixing apparatus F in a low-temperature environment, which was thought to be a concern in the case of using side-chain type PFPE as the base oil of the lubricant, can be reduced by blending even a small amount of straight-chain type PFPE. In this embodiment, the starting torque of the heat fixing apparatus F in a low-temperature environment poses no practical problem if the blending ratio of straight-chain type PFPE is at least 20% or more.

(5) Comparison of Conditions of Image Forming Apparatus after Endurance Testing Next, using the lubricants described above, a comparison examination was conducted on the endurance of the heat fixing apparatus F, which was thought to be another concern in the case of using side-chain type PFPE as the base oil of the lubricant.

As for the endurance of the heat fixing apparatus F, the condition of a lubricant left on the surface of the heater 21, which slides against the inner peripheral surface of the fixing film 23, was visually examined after enduring testing in which one hundred thousand electrophotographic images were formed by an image forming apparatus using each lubricant of the examples and the comparative examples. Then, endurance of the image forming apparatus was compared based on the degree of degradation of the lubricant.

Here, degradation of the lubricant refers to a condition in which the rotational movement of the fixing film 23 cannot be performed in a stable manner, which scraped powder of members, such as the fixing film 23 and the guide 22, is generated from the sliding surfaces of the fixing film 23 and the guide 22 due to depletion of the lubricant from the sliding friction part resulting from the drain of the lubricant in the endurance testing, and the lubricant undergoes a color change and increases its viscosity when the scraped powder is mixed to the lubricant. The results are shown in Table 3.

Codes representing the conditions of the lubricants in Table 3 are defined as follows.

A: Problem-free level with minor degradation of the lubricant.

B: Practically problem-free level although slight degradation of the lubricant is present.

C: Level at which the lubricant is degraded and the conveyance performance of the recording material P is thought to become unstable due to a decrease in sliding performance between the heater 21 and the fixing film 23.

TABLE 3

| | Base oil | | | | Condition of lubricant on |
|---|---|---|---|---|---|
| | Straight-chain type | | Side-chain type | | heater after |
| Lubricant | Molecular weight | Blending ratio | Molecular weight | Blending ratio | endurance testing |
| Example 1 | 8,000 | 80% | 7,000 | 20% | A |
| Example 2 | 8,000 | 50% | 7,000 | 50% | A |
| Example 3 | 8,000 | 20% | 7,000 | 80% | B |
| Comparative Example 1 | 8,000 | 100% | — | 0% | A |
| Comparative Example 2 | 12,000 | 100% | — | 0% | A |
| Comparative Example 3 | — | 0% | 7,000 | 100% | C |

As shown in Table 3, in the case of Comparative Examples 1 and 2 of the lubricants including the straight-chain type base oil only, the condition of the lubricant after the endurance testing was favorable. On the other hand, in the case of Comparative Example 3 of the lubricant including the side-chain type base oil only, the condition of the lubricant after the endurance testing was poor. As for the examples of the lubricants including a blend-type base oil, even though the blending ratio of the side-chain type base oil was as much as 80%, the condition of the lubricant was favorable compared to Comparative Example 3 of the lubricant including the side-chain type base oil only, and was at a level in which there was practically no problem (Example 3). Further, when the blending ratio of the side-chain type base oil was 50% or less, the condition of the lubricant was as favorable as those of Comparative Examples 1 and 2 of the lubricant including the straight-chain type base oil only (Examples 1 and 2).

Thus, simply by blending a small amount of the straight-chain type base oil with the side-chain type base oil as in Example 3, the condition of the lubricant on the surface of the heater after the endurance testing was improved to a level in which there was practically no problem compared to the case of using the side-chain type base oil only as in Comparative Example 3. This is considered due to a reduction in the drain of the lubricant from the edges of the fixing film 23, which is achieved by blending even a small amount of the straight-chain type base oil, having kinetic viscosity less dependent on temperature, with the side-chain type base oil and thereby creating a partial region capable of maintaining high viscosity even in a high-temperature environment.

That is, the endurance of the heat fixing apparatus F, which was thought to be a concern in the case of using side-chain type PFPE as the base oil of the lubricant, can be brought to a level of no practical problem by blending even a small amount of straight-chain type PFPE. In this embodiment, the endurance of the heat fixing apparatus F poses no practical problem if the blending ratio of straight-chain type PFPE is at least 20% or more.

Note that, the image heating apparatus of the present invention is not limited to a heat fixing apparatus, and may be used as an image heating apparatus for temporary fixing and an image heating apparatus for reheating a recording material supporting thereon an image and reforming the image surface properties to give a glossy appearance.

As described above, according to the present invention, cracks and fissures occurring in the surface layer of the fixing film as well as a decrease in image quality can be suppressed by using the lubricant made of PFPE in which the straight-chain type and the side-chain type are blended together. In addition, stable conveyance of the recording material can be achieved through endurance testing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-254814, filed Nov. 15, 2010, which is hereby incorporated by reference herein in its entirety.

What is claimed is:

1. A heating apparatus, comprising:

a rotating member which has a surface layer comprising fluororesin, has flexibility and is open at both ends thereof;

a heating member for heating the rotating member;

a holding member for the rotating member, which is disposed inside the rotating member and has a sliding surface against an inner peripheral surface of the rotating member; and a pressurizing member for forming a nip portion together with the rotating member, the heating apparatus heating a recording material while conveying the recording material by nipping at the nip portion and rotating the rotating member and the pressurizing member, wherein a lubricant comprising a straight-chain type perfluoropolyether and a side-chain type perfluoropolyether is interposed between the rotating member and the sliding surface of the holding member.

2. The heating apparatus according to claim 1, wherein said side-chain type perfluoropolyether has a trifluoromethyl group as a side chain thereof.

* * * * *